United States Patent [19]

Nakama et al.

[11] Patent Number: 4,898,549

[45] Date of Patent: Feb. 6, 1990

[54] CONNECTOR BUILT FROM ONE OR MORE SINGLE ROWED HOUSINGS, WITH LONG LASTING LOCKING MECHANISM

[75] Inventors: Katsuhiko Nakama, Nagaokakyo; Hiroshi Ninomiya, Uji; Toru Michishige, Nagaokakyo; Fumiaki Itsuki, Ibaraki, all of Japan

[73] Assignee: Omron Tateisi Electronics Co., Kyoto, Japan

[21] Appl. No.: 318,443

[22] Filed: Feb. 28, 1989

Related U.S. Application Data

[60] Continuation of Ser. No. 101,024, Sep. 24, 1987, abandoned, which is a division of Ser. No. 823,329, Jan. 28, 1986, Pat. No. 4,709,976.

[51] Int. Cl.[4] ..... H01R 13/514

[52] U.S. Cl. ..... 439/701; 439/715

[58] Field of Search ..... 439/594, 687, 696, 716, 439/717, 731, 732, 906, 701

[56] References Cited

U.S. PATENT DOCUMENTS

| | | | |
|---|---|---|---|
| 1,866,407 | 7/1932 | Guett | 439/731 |
| 1,898,589 | 2/1933 | Meuer | 439/687 |
| 3,848,951 | 11/1974 | Michaels et al. | 439/717 |
| 4,099,821 | 7/1978 | Debaigt | 439/717 |
| 4,175,818 | 11/1979 | Kourimsky et al. | 439/594 |
| 4,408,823 | 10/1983 | Huber | 439/404 |
| 4,435,035 | 3/1984 | Berry et al. | 439/404 |
| 4,464,003 | 8/1984 | Goodman et al. | 439/404 |
| 4,591,228 | 5/1986 | Vasseur | 439/717 |
| 4,735,583 | 4/1988 | Rudy, Jr. et al. | 439/751 |

FOREIGN PATENT DOCUMENTS

| | | | |
|---|---|---|---|
| 120576 | 2/1982 | Japan . | |
| 0063139 | 5/1949 | Netherlands | 439/717 |

*Primary Examiner*—Gary F. Paumen

*Attorney, Agent, or Firm*—Stevens, Davis, Miller & Mosher

[57] ABSTRACT

This electric connector includes a housing formed with a single row of holes for receiving male terminals and ends of sheathed wires connected thereto, and further formed with means for, if and when two of the housings are laid together with their two single rows of holes substantially parallel, locating them with respect to mutual sliding movement. Thereby, if it is desired to provide only a single row type connector, a single one of such housings is used by itself; but, if it is desired to provide a multiple row type connector, then two or more of such housings are laid together with their single rows of holes substantially parallel, and now the locating means keeps them from undergoing mutual sliding. Optionally, the connector can further include means such as a clip for holding together these several housings.

4 Claims, 5 Drawing Sheets

CONNECTOR BUILT FROM ONE OR MORE SINGLE ROWED HOUSINGS, WITH LONG LASTING LOCKING MECHANISM

This application is a continuing application of Ser. No. 101,024, filed Sept. 24, 1987, now abandoned, which is a divisional application of Ser. No. 823,329, filed Jan. 28, 1986, now U.S. Pat. No. 4,709,976.

BACKGROUND OF THE INVENTION

The present invention relates to the field of electrical connectors, and more specifically relates to a novel type of electrical connector which can be built up from one or several single layered slabs, and which has a novel type of long lasting locking mechanism for locking it to a base portion. Such an electrical connector may be used, for example, for connecting electrical conductors for transmission of electrical signals between a computer and a terminal, or the like.

A conventional type of electrical connector is for example of the type exemplarily shown in perspective view in FIG. 4 of the accompanying drawings; this exemplary connector is a two row type connector. In this drawing, the housing for the connector is designated by the reference numeral 1, and this housing 1 has a mating end 1*a* on its one side and a terminal fitting end 1*b* on its other end. The portion of the housing 1 at the connector fitting end 1*b* is formed as a terminal insertion portion 3 formed with a plurality of sheathed electric wire connection holes 4 opening to the terminal fitting end 1*b* at fitting openings 6, said terminal insertion portion 3 being open at the top side thereof as seen in the figure, and each of these sheathed electric wire connection holes 4 extends through the housing 1 of the connector to open at its mating end 1*a* as an insertion hole 5 for a male terminal formed on an external base, not particularly shown. This electrical connector is used, in a manner not particularly shown in the drawings, by fitting a female terminal into each of the plurality of sheathed electric wire connection holes 4, through the fitting openings 6 from the terminal fitting end 1*b* side of the housing 1, so that the receptive ends of said female terminals oppose the respective insertion holes 5. Then the ends of sheathed electrical wires (also not particularly shown) are passed through the fitting openings 1 and are joined to the other ends of said female terminals by crimping or soldering or the like process, and finally a cover (also not shown) is fitted over the open side of the terminal insertion portion 3, so as to securely hold the female terminals in the housing 1. In use, the mating end 1*a* of the connector is moved towards a base (not particularly shown) which has a plurality of male terminals protruding therefrom in an identical configuration to at least some of the insertion holes 5, with the electrical wires connected to the other ends of the female terminals trailing out from the terminal fitting end 1*b* of the connector, and said male terminals are thus inserted into their said insertion holes 5 so as to mate with the respective female terminals therein and make electrical contact therewith.

Further, as shown in schematic end on view in FIG. 8 of the accompanying drawings, in some cases a locking mechanism for such a connector is conventionally provided, for locking the main body of the connector, designated in this figure by the reference numeral 103, to a base 101 which has such male terminals mounted in it; this structure is of a type disclosed in Japanese Utility Model Laying Open Publication Ser. No. 120576, which it is not intended hereby to admit as prior art to the present application except to the extent otherwise required by applicable law, and reference should be made to this publication, should further details be required. The base 101 is typically fixed to a board such as a printed circuit board by soldering or the like, and has a projection 102 on its side, and the main body 103 of the connector has a lock piece 104 integrally formed as projecting from its side, said lock piece 104 being formed with an engaging pawl shape 105 for engaging with the projection 102 of the base 101, and for thus holding the body 103 of the connector squarely against said base 101 with the male terminals (not particularly shown) of said base 101 securely mating with the female terminals (also not shown). In detail, when performing the operation of fitting the body 103 of the connector to the base 101, while said body 103 is being approached towards the base 101, a sloped side 105*a* of the pawl shape 105 slides against a sloped side 102*a* of the projection 102, thereby somewhat bending the lock piece 104 against its elasticity and allowing the pawl shape 105 to pass over the projection 102. Thereafter, the inherent elasticity of the lock piece 104 keeps its pawl shape 105 pressed against and engaging with the projection 102, thus holding the body 103 of the connector squarely against the base 101. And, when it is desired to release the body 103 of the connector from the base 101, then typically said body 103 is forcibly pulled away from the base 101, and another sloped side 105*b* of the pawl shape 105 now slides against another sloped side 102*b* of the projection 102, thereby again somewhat bending the lock piece 104 against its elasticity and allowing the pawl shape 105 to pass back over the projection 102, to release the body 103 from the base 103. As an alternative, the lock piece may be bent back by hand or by the end of a screw driver or the like, again against its own elasticity.

However, certain problems arise with such conventional structures for an electrical connector, as follows.

First, with reference to the structure of the connector itself as shown in FIG. 4 of the drawings, since the number of sheathed electrical wires to be connected to the terminals of the base board can vary dramatically, depending upon the type of electrical equipment used for each specific application or upon the location in which such equipment is to be fitted, several configurations for the terminals and for the corresponding insertion holes 5 have been adopted. Most typically, they have been arranged either in one row or in two parallel rows as shown in the FIG. 4 example, although configurations employing even more rows have occasionally been utilized. An appropriate one of these configurations is required to be selected for each particular application. Accordingly, although in principle these two types of electrical connectors are basically similar, nevertheless the number of component parts that are required to be made in order to fabricate a comprehensive line of connectors incorporating both single row and double row types becomes large, and, since it is required to form the parts for the double row housings and the parts for the single row housings for the two types of connector by different sets of metal dies, the work and cost of development and tooling are similarly increased. Further, stocking problems and parts management problems become more troublesome. Another problem is that, when the sheathed electrical wires are connected to the female terminals received inside the housing by crimping with a tool as is typical. different crimping tools are required to be utilized for double row housing type connectors and single row housing type connectors, and this is troublesome for the user.

Next, with reference to the locking mechanism for fixing the connector to a base as shown in FIG. 8 of the drawings, the problem with this is that after a long period of service life and many repeated matings and separatings of the connector main body 103 to the base 101, and accompanying bendings to and fro of the lock piece 4, this lock piece 4 may well lose its elasticity due to fatigue, with the result that the locking mechanism may fail in its function. And, because conventionally the lock piece 4 is integrally molded with the main body 3 of the connector, when the lock piece 4 has thus become ineffective for locking, it has heretofore been necessary to change the entire connector in order to remedy this locking problem, which is very troublesome and usually would be neglected by a user, with consequent risk of poor connection problems occurring.

SUMMARY OF THE INVENTION

Accordingly, it is the primary object of the present invention to provide an electrical connector, which avoids the above described problems.

It is a further object of the present invention to provide such an electrical connector, which is adaptable to being easily manufactured in several configurations.

It is a further object of the present invention to provide such an electrical connector, which reduces the number of different parts required for manufacture of a comprehensive line of configurations thereof.

It is a further object of the present invention to provide such an electrical connector, which requires less tooling work for production of single row and double row configurations thereof.

It is a further object of the present invention to provide such an electrical connector, which reduces overall development cost and work.

It is a yet further object of the present invention to provide such an electrical connector, which reduces stock and parts management problems.

It is a yet further object of the present invention to provide such an electrical connector, which allows a double row configuration thereof to be manufactured by utilizing the dies for making the single row configuration thereof and by combining the resulting single row connectors.

It is a yet further object of the present invention to provide such an electrical connector, which reduces the number of crimping tools required to be provided by a user.

It is a yet further object of the present invention to provide such an electrical connector, which has a locking mechanism which is reliable over a long service life.

It is a yet further object of the present invention to provide such an electrical connector, which further has a locking mechanism in which the part subject to wear can easily be replaced.

It is a yet further object of the present invention to provide such an electrical connector, the locking mechanism of which is easily assembled.

According to the present invention, these and other objects are accomplished by an electric connector, comprising: a housing formed with a single row of holes for receiving male terminals and for receiving ends of sheathed wires connected thereto; and further formed with: means for, if and when two of said housings are laid together with their two said single rows of holes substantially parallel, locating them with respect to one another to prevent mutual sliding movement; and according to another aspect of the present invention, similarly these and other objects are accomplished by an electric connector for being engaged with a fixed base, comprising a main housing formed with an engagement aperture on its side, and a lock mechanism comprising a catch piece formed with: a bent intermediate portion; a protruding press portion; a protruding engaging portion, formed with a catch shape for engaging with said fixed base; and an elastic fixing tongue engaged into said engagement aperture so as elastically to support said catch piece on the side of said main housing with said bent portion pressing against said main housing and acting as a fulcrum, and in this state biasing said protruding press portion in the direction away from said main housing and said protruding engaging portion in the direction towards said main housing.

According to the first of these aspects of the present invention, since it is possible either to utilize such a single row housing on its own, or to utilize two or even more of such housings as laid together and mutually located by said locating means, the number of different parts required for manufacture of a comprehensive line of configurations of connectors is substantially reduced over the prior art, because the only tools needed for parts production relate to production of the single row type connector housings, and typically also to coupling clips which are relatively simple to make. Thereby, less tooling work is required for production of single row and double row connector configurations, and overall development cost and work are reduced. Similarly, stock and parts management problems are reduced. Further, during the use of various ones of these connectors, both the single and double row type, the same crimping tool can be used for coupling wires thereto, and accordingly the number of crimping tools required to be provided by a user is halved. And, according to the second of these aspects of the present invention, since the catch shape on the engaging portion is displaced away from the portion of the base that engages to it, when being moved past it, and is not required to slide over or to be forced over said engaging portion of the base either when the connector main body is being fitted to the base or when it is being removed therefrom either, there is virtually no wear on said catch shape or on said engaging portion of said base, and it is virtually impossible that either of them should become worn out with use. And further, when the elasticity of the tongue portion starts to fail because of repeated use over a long service life, it is quite easy to replace the catch piece by itself, which does not entail removing or otherwise adjusting the sheathed wires which are fitted to the connector main body. Thus according to this construction there is provided an electrical connector, which has a locking mechanism which is reliable over a long service life, and the part of which is subject to wear can easily be replaced. Further, this locking mechanism is easily assembled.

BRIEF DESCRIPTION OF THE DRAWINGS

The present invention will now be shown and described with regard to certain of the preferred embodiments thereof, and with reference to the illustrative drawings, which however should not be considered as limiting the present invention in any way, since the scope of the present invention is to be considered as being delimited solely by the accompanying claims, rather than by any particular features of the disclosed embodiments or of the drawings. In these drawings:

DESCRIPTION OF THE PREFERRED EMBODIMENTS

Figure 1:
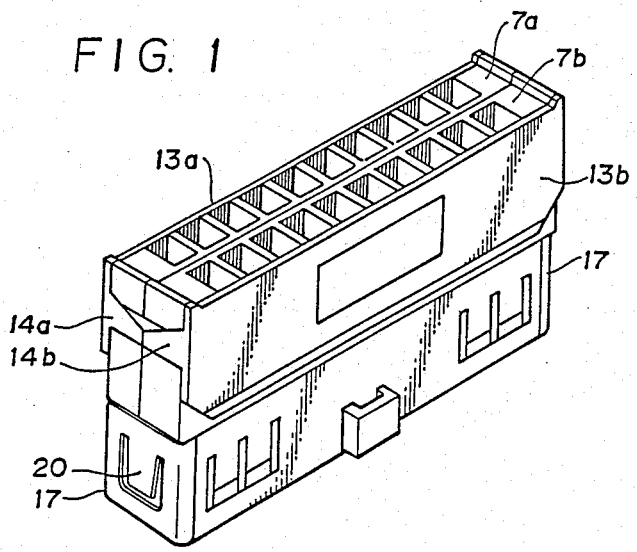
FIG. 1 is a perspective view of the first preferred embodiment of the electrical connector of the present invention in its assembled form, said electrical connector being made up from two single row slab type electrical connectors clipped together.
Figure 2:
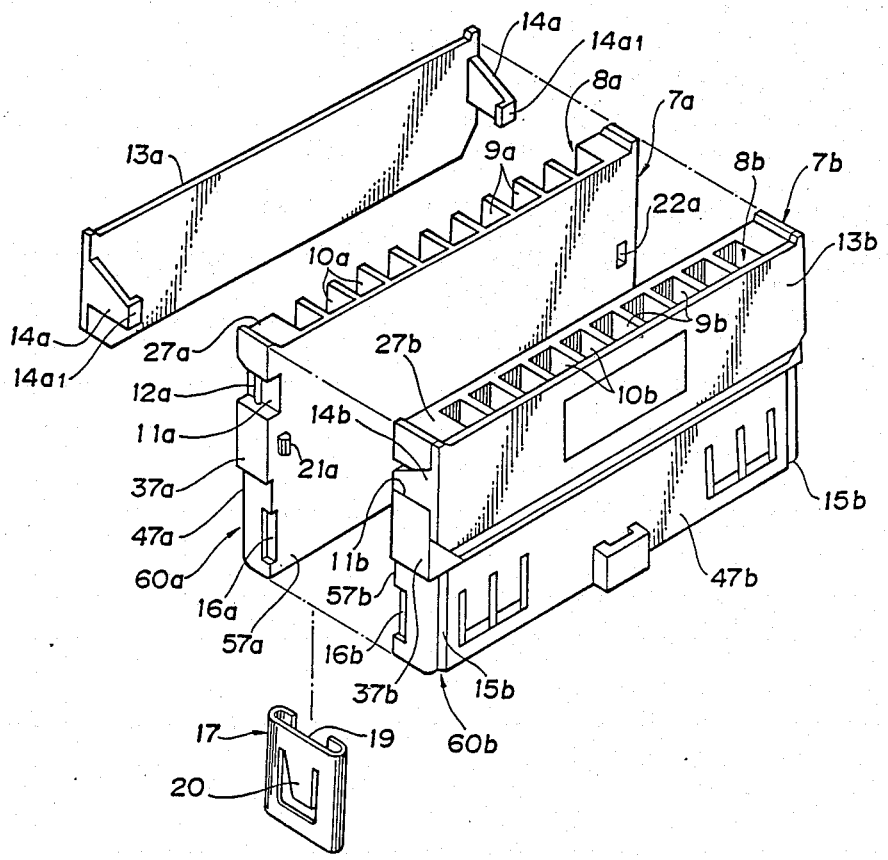
FIG. 2 is an exploded perspective view of said first preferred embodiment electrical connector, with said two single row slab type electrical connectors being somewhat separated.

The present invention will now be described with reference to the preferred embodiments thereof. FIG. 1 shows the first preferred embodiment of the present invention, which is a double row type connector made up by clipping together two single row type connectors back to back as will be explained hereinafter, said single row type connectors also being embodiments of the present invention. This figure, which is a perspective view, shows the connector in its assembled form, while FIG. 2 shows an exploded perspective view thereof. In these figures, the reference numerals 7a and 7b denote left and right ones of said single row type connectors, and covers 13a and 13b respectively are provided therefor.

In detail, referring particularly to FIG. 2, the first single row connector 7a will now be described; the other single row connector 7b is exactly the same but is positioned in a back to back orientation thereto with its two longitudinal ends reversed, and like parts therein to parts of the first connector 7a are denoted by the same reference numerals, but with a "b" affixed thereto instead of an "a". The single row connector 7a comprises a female terminal insertion portion 8a at its upper portion in the figures and a mating portion 60a at its lower portion in the figures. The female terminal insertion portion 8a of the connector 7a is formed with a single row of sheathed electrical wire insertion depressions 10a on its outer face 27a, and these depressions 10a open to a corresponding single row of wire connection holes 9a on the upper edge in the figures of the connector 7a. The cover 13a, which is affixed by means shortly to be described, covers over the depressions 10a to leave only the connection holes 9a open. And the lower mating portion 60a of the connector 7a in the figures is formed, although this is not shown, with a corresponding plurality of male terminal receiving apertures, one opening to the end of each of the sheathed electrical wire insertion depressions 10a. Thus, these male terminal receiving apertures are also arranged in a single row upon the under edge (not shown) of the connector 7a.

At each end of the cover 13a there is formed a projecting catch 14a with a tooth shape 14a1 at its end. At corresponding positions on the end faces 37a of the female terminal insertion portion 8a of the connector 7a there are formed notches 11a with projections 12a therein. Thus, when the cover 13a is approached to and pressed against the side of the connector 7a to cover the depressions 10a therein, the catches 14a fit into the notches 11a, with the tooth shapes 14a1 engaging with the projections 12a, and thereby said cover 13a is securely held to the main body of the connector 7a.

Figure 3:
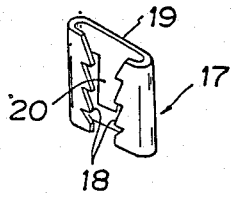
FIG. 3 is a perspective view of a coupling clip used for clipping together said two single row connectors.
Figure 4:
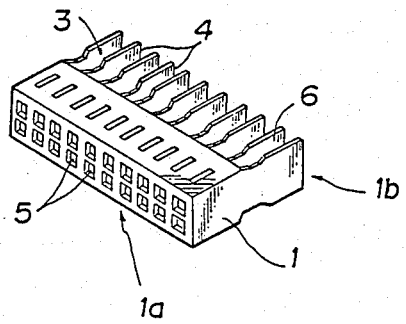
FIG. 4 PRIOR ART
FIG. 4 is a perspective view showing a conventional double row type connector.

Now, the arrangements for clipping together the two single row connectors 7a and 7b will be described. This clipping is performed using two coupling clips 17, shown in FIG. 2 and one of which is also shown separately in perspective view in FIG. 3. This exemplary coupling clip 17 is made of relatively springy metal, in cross section is like a flattened C shape, and comprises a main body portion 19, two engaging portions 18 extending along opposite edges thereof and being bent around, the free edges of said edge portions 18 being formed with serrations, and a lock piece 20 formed integrally with the main body portion 19 in a cut out portion thereof, said lock piece 20 being somewhat bent out of the plane of said main body portion 19 in the direction of the engaging portions 18. Corresponding to these coupling clips 17, the outer side surface 47 of each of the single row connectors 7 is formed with engaging grooves 15 extending in the vertical direction in the figures along each of its end portions, and the lower portion in the figures of each of the end faces 37 of said connectors 7 is somewhat cut away and is further formed with a catch notch 16 on its inner edge. Further, on the inner face 57 of each of the single row connectors 7a and 7b there are formed, at the one end a small engagement projection 21, and at the other end a corresponding small engagement depression 22.

According to the above described first embodiment type structure, when it is desired to manufacture single row type connectors, only single ones of the single row type connectors 7a or 7b (which are identical) are manufactured and supplied.

On the other hand, when it is desired to manufacture double row type connectors, then twice as many of the single row type connectors 7a or 7b are manufactured, and then they are connected together in pairs in the following way. First, two of said single row type connectors are put back to back, with the engagement projection 21 of each fitting into the engagement depression 22 of the other so as to locate them with respect to one another. Next, at each end of the resulting combination, one of the FIG. 3 type of coupling clips 17 is fitted thereto, by its two engaging portions 18 being slightly bent outwards (utilizing the elasticity of the metallic material of the clip) and the upper end of each then being inserted into the bottom as seen in the figure of one of the engaging grooves 15, and by the coupling clip 17 then being pushed in the upwards direction in the figure so as to slide over the lower portion of this end face 37 of the combined pair of connectors 7a and 7b. As this is done, initially the lock piece 20 is somewhat bent by being pressed against the end face 37, but when the lock piece 20 comes to oppose the mutually conjoined catch notches 16 on said end face 37, it snaps thereinto, thereby providing a retaining effect for the coupling clip 17, which thereafter is retained in this position by said lock piece 20, as well as by the action of the serrations formed on the free edges of the edge portions 18 of the engaging portions 18 of said clip 17.

Thus, the two single row type connectors *7a* and *7b* are connected together as a pair, to constitute a double row type connector. Because the two single rows of sheathed electrical wire insertion depressions 10*a* on the outer faces 27*a* of these connectors *7a* and *7b* both face outwards, it is possible subsequently to affix sheathed electrical wires to the combination double row type connector in the same way as has been performed with conventional type double row type connectors. The way in which the covers 13*a* and 13*b* can be subsequently mounted to this conjoined pair of two single row type connectors *7a* and *7b* has already been implicitly explained, and is in fact no different from the way in which such a cover mounting process is performed in the case that one of the single row type connectors 7 is to be used by itself.

Accordingly, it is seen that there is provided an electrical connector, which avoids the problems described above with respect to conventional art. Particularly, this electrical connector is adaptable to being easily manufactured in several configurations; indeed, it would not be impossible, or outside the scope of the present invention, for more than two of the single row type connectors 7 to be fixed together. Accordingly, the number of different parts required for manufacture of a comprehensive line of configurations of connectors is substantially reduced over the prior art, because the only tools needed for parts production relate to production of the single row type connectors 7, and of course the coupling clips 17 which are relatively simple to make. Thereby, less tooling work is required for production of single row and double row connector configurations, and overall development cost and work are reduced. Similarly, stock and parts management problems are reduced. Further, during the use of various ones of these connectors, both single and double row type, the same crimping tool can be used for coupling wires thereto, and accordingly the number of crimping tools required to be provided by a user is halved.

Figure 5:
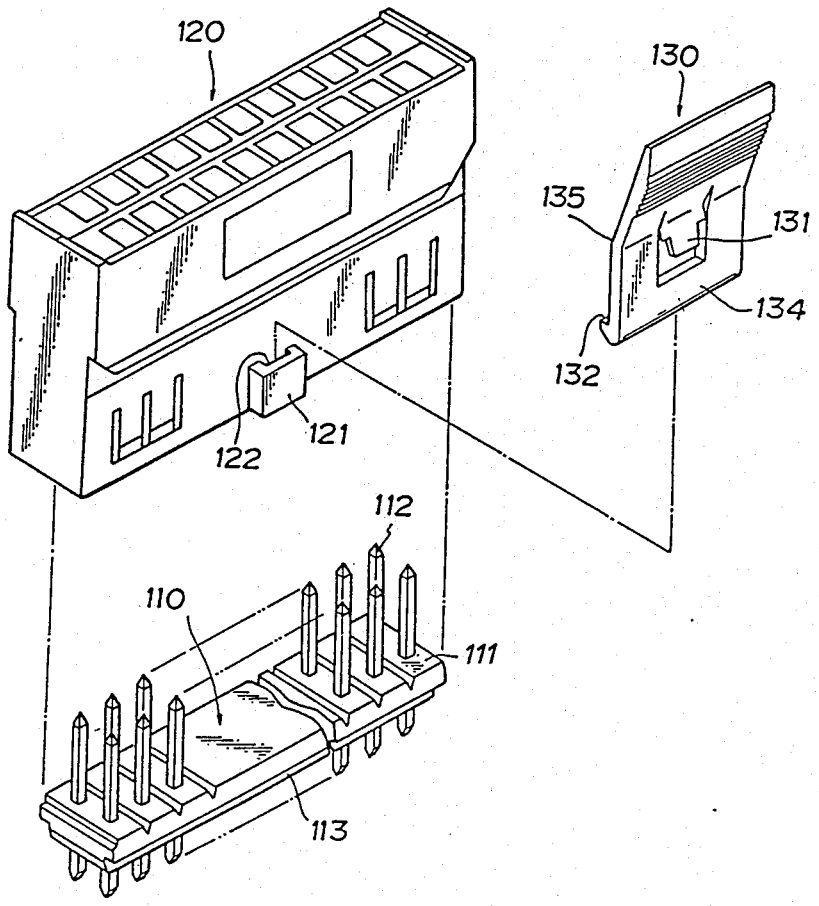
FIG. 5 is a perspective view of the second preferred embodiment of the electrical connector of the present invention shown as removed from a base thereof, a catch portion being separated from said electrical connector.

Now, referring to FIGS. 5 through 7 of the drawings, a second preferred embodiment of the present invention will be explained. The gist of this second preferred embodiment relates to the provision of a novel type of locking mechanism for locking the connector main body to a base; accordingly, in these figures, the connector main body itself, which is a double row type of connector, is illustrated as monolithic, although in fact it may be made as two conjoined single row type connectors as described above with reference to the first preferred embodiment. FIG. 5 shows the connector main body 120 along with its associated base assembly 110 in perspective view with said main body 120 somewhat removed from said base assembly 110, while on the other hand FIG. 7 shows a side view of these elements as locked together by the locking mechanism. In detail, the base assembly 110 comprises a plurality of pins 112 arranged in two parallel rows and fixed to pass through a base plate 111, and, although this is not particularly shown, the lower portions in the figures of the pins 112 are inserted into holes formed in a printed circuit board and are soldered therein, so as firmly to hold the base assembly 110 to said printed circuit board with the upper ends of the pins 112 sticking up therefrom.

The central portion of one side edge of the base plate 111 defines a clipping portion 113.

The connector main body 120 is shown in FIG. 5 as substantially box shaped, and it may be of the type disclosed above, or it may be internally provided with fittings (not particularly shown) for connecting the pins 112 of the base assembly 111 with surface projections and the external connection terminals of equipment such as a relay or a switch which are inserted from the surface portion. A catch fitting projection 121 is formed on a central portion of a lower edge of one side of the connector main body 120. In fact, one such catch fitting projection 121 may be provided on each side of the connector main body 120, to make two in all (this is typically the case when the connector main body is formed as described with respect to the first embodiment, and such a catch fitting projection is illustrated in FIGS. 1 and 2); and in such a case either two of the catch systems to be described shortly may be fitted, or alternatively only one may be fitted, and in that case one of the catch fitting projections 121 will be unused. The catch fitting projection 121 is formed with a catch engagement hole 122 extending through it in the vertical direction in the figures.

A catch piece 130 is formed as shown in perspective view in FIG. 5. It has: a main body portion 134; a press portion 130 extending at an oblique angle from said main body portion 134, and joined thereto at a bent joining portion 135, which is formed with a roughened or serrated surface for easy pressing; a fitting tongue portion 131 formed in a cutaway in the approximate center of said main body portion 134; and a catch ledge 132 extending along the edge of the main body portion 134 remote from the bent joining portion 135. This catch piece 130 is formed of a relatively elastic material, so that, particularly, the fitting tongue portion 131 is quite elastic. The width of said fitting tongue portion 131 is approximately the same as the width of the catch engagement hole 122 formed through the catch fitting projection 121.

Figure 6:
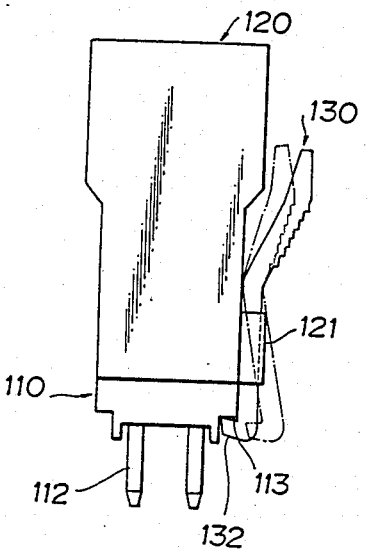
FIG. 6 is an end on view of said second preferred embodiment electrical connector as fitted to its base, showing two positions for the catch portion by solid and by phantom lines.
Figure 7:
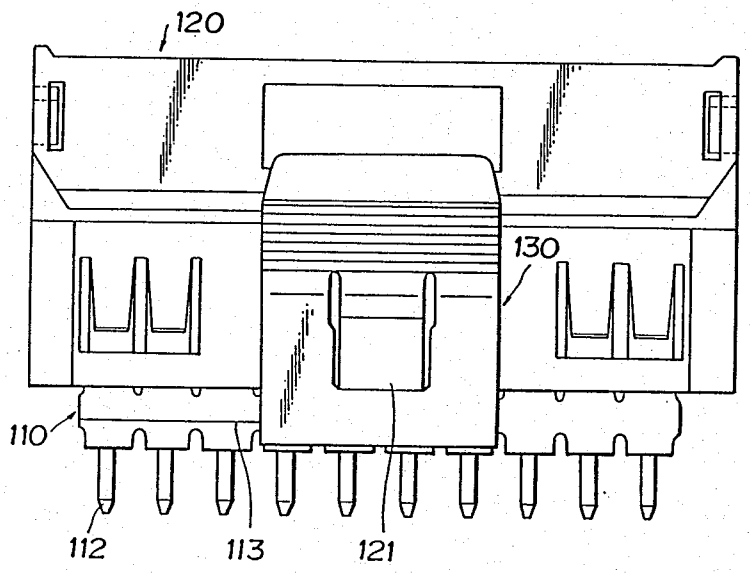
FIG. 7 is a side view showing said second preferred embodiment electrical connector as fitted to its base.

This catch piece 130 is fitted to the main body 120 of the connector, as shown in FIGS. 6 and 7, by its fitting tongue portion 131 being inserted from above (in the figures) into the catch engagement hole 122 of the catch fitting projection 121 and slid thereinto so as to be firmly lodged therein. In this position, the elasticity of said tongue portion 131 biases the catch piece 130 as a whole in the clockwise direction as seen in FIG. 6, to its position as shown in that figure by the solid lines, so as to press the main body portion 134 and particularly the catch ledge 132 formed thereon towards said connector main body 120 while biasing the press portion 130 away from said connector main body 120 so as to cause it to project therefrom.

As will be easily understood based upon the foregoing explanation, when a user wishes to fit the connector main body 120 to the base assembly 110, he or she merely needs to press with his or her finger said press portion 130 of the catch piece 130 towards said connector main body, so as to tilt the entire catch piece 130 as a whole in the anticlockwise direction as seen in FIG. 6 around the bent joining portion 135 which acts as a fulcrum to its position as shown in that figure by the phantom lines, against the elastic action of the tongue portion 131 which is overcome, which causes the main body portion 134 and particularly the catch ledge 132 formed thereon to be moved away from said connector main body 120. This can be accomplished with a simple pinching action, by only squeezing the connector body as a whole between thumb and forefinger. In this state, said connector main body 120 can easily be fitted to the base assembly 110, with the pins 112 passing into the holes (not shown) of said connector main body 120, while the catch ledge 132 of the catch piece 130 easily passes over the clipping portion 113 of the base plate 111. Then, the user releases this pressing of the press portion 130, which allows the elastic action of the tongue portion 131 to now rotate the catch piece 130 as a whole in the clockwise direction as seen in FIG. 6 to its position as shown in that figure by the solid lines, thus biasing the main body portion 134 of the catch piece 130 and particularly the catch ledge 132 formed thereon towards said connector main body 120. This allows the catch ledge 132 to become engaged with the clipping portion 113 of the base plate 111, so as securely to retain the connector main body 120 on the base assembly 110.

And, when removing the connector main body 120 from the base assembly 110, this procedure needs merely to be reversed: the user again presses with his or her finger the press portion 130 of the catch piece 130 towards said connector main body 120, so as to tilt the catch piece 130 in the anticlockwise direction as seen in FIG. 6 to its position as shown in that figure by the phantom lines against the elastic action of the tongue portion 131 which is overcome, thus causing the main body portion 134 and the catch ledge 132 formed thereon to be again moved away from said connector main body 120. In this state, said connector main body 120 can easily be removed from the base assembly 110, while the catch ledge 132 of the catch piece 130 again easily passes over the clipping portion 113 of the base plate 111. Then, the releases this pressing of the press portion 130, to release the connector main body 120.

The roughened or serrated surface formed on the press portion 130 is convenient for aiding this pressing by the user's finger and for slippage prevention.

Figure 8:
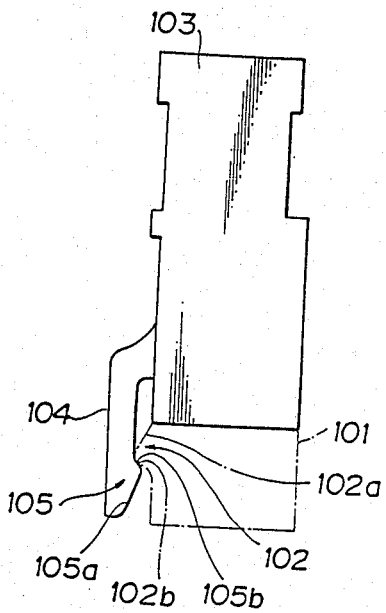
FIG. 8 PRIOR ART
FIG. 8 is a schematic end on view of a prior art type connector and its base, showing a conventional locking mechanism for coupling them together.

In this shown second preferred embodiment of the present invention, in contrast to the prior art construction described above and shown in FIG. 8, since the catch ledge 132 is displaced away from the clipping portion 113 of the base plate 111 when being moved past it, and is not required to slide over or to be forced over said clipping portion 113 either when the connector main body 120 is being fitted to the base assembly 110 or when it is being removed therefrom either, there is virtually no wear on said catch ledge 132 or on said clipping portion 113 of said base plate 111, and it is virtually impossible that they should become worn out with use. And further, when the elasticity of the tongue portion 131 starts to fail because of repeated use over a long service life, it is quite easy to replace the catch piece 130 by itself, which does not entail removing or otherwise adjusting the sheathed wires (not shown) which are fitted to the connector main body 120. Accordingly it is seen that according to this second preferred embodiment of the present invention there is provided an electrical connector, which has a locking mechanism which is reliable over a long service life, and the part of which is subject to wear can easily be replaced. Further, this locking mechanism is easily assembled.

Although the present invention has been shown and described in terms of certain preferred embodiments thereof, and with reference to the appended drawings, it should not be considered as being particularly limited thereby. The details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the legitimate and properly interpreted scope of the accompanying claims, which follow.

What is claimed is:

1. An electrical connector for coupling a plurality of wires to male terminals, comprising:

a first housing formed at one end thereof with a first single row of holes for receiving a plurality of male terminals and at another end and on a front surface thereof with a first single row of wire insertion depressions, each hole of said first single row of holes being in communication with a respective depression of said first single row of wire insertion depressions, said first housing including a first positioning means disposed on a rear surface thereof; and a second housing identical to said first housing formed at one end thereof with a second single row of holes for respectively receiving a plurality of male terminals and at another end and on a front surface thereof with a second single row of wire insertion depressions, each hole of said second single row of holes being in communication with a respective depression of said second single row of wire insertion depressions, said second housing including a second positioning means disposed on a rear surface thereof, wherein said said rear surfaces abut one another and are joined together through said first and second positioning means; and, at least one coupling member separate from said housings for coupling said first and second housings together to form an integrated connector.

2. An electrical connector as in claim 1 wherein each of said first and second housings includes at least one external groove therein, said coupling member being formed as a clip which engages with corresponding grooves of said first and second housings to hold said housings together.

3. An electrical connector as in claim 2 wherein each of said first and second housings has opposite side edges and includes an external groove provided adjacent each of its side edges, said terminal further comprising two coupling members in the form of clips which engage with respective pairs of said grooves provided adjacent said opposite side edges of said first and second housings.

4. An electrical connector as in claim 1 wherein said integrated connector has all of the holes of said first and second housings on one end thereof and all of the wire insertion depressions of said first and second housings on another end thereof.

* * * * *